US007383920B2

(12) United States Patent
Meeker

(10) Patent No.: US 7,383,920 B2
(45) Date of Patent: Jun. 10, 2008

(54) STEP STOOL WITH MOVABLE HANDRAIL

(75) Inventor: Paul K. Meeker, Hiram, OH (US)

(73) Assignee: Cosco Management, Inc., Wilmington, DE (US)

( * ) Notice: Subject to any disclaimer, the term of this patent is extended or adjusted under 35 U.S.C. 154(b) by 644 days.

(21) Appl. No.: 10/184,361

(22) Filed: Jun. 27, 2002

(65) Prior Publication Data

US 2004/0000449 A1 Jan. 1, 2004

(51) Int. Cl.
*E06C 7/18* (2006.01)

(52) U.S. Cl. ..... 182/106; 182/129

(58) Field of Classification Search ..... 182/106, 182/113, 129; 248/238
See application file for complete search history.

(56) References Cited

U.S. PATENT DOCUMENTS

| | | | | | |
|---|---|---|---|---|---|
| 294,199 | A | * | 2/1884 | Coyles | 182/204 |
| 376,102 | A | * | 1/1888 | Miller | 182/177 |
| 656,946 | A | * | 8/1900 | Corduan | 182/106 |
| 1,179,391 | A | * | 4/1916 | Bachman | 182/204 |
| 2,208,266 | A | * | 7/1940 | Meier | 182/177 |
| 2,614,744 | A | * | 10/1952 | Hedglon | 182/106 |
| 2,923,373 | A | * | 2/1960 | Ledgerwood | 182/102 |
| 3,139,154 | A | * | 6/1964 | Ewald | 182/106 |
| 3,305,045 | A | * | 2/1967 | Schlecht | 182/97 |
| 4,320,816 | A | * | 3/1982 | Callahan et al. | 182/55 |
| 5,342,008 | A | | 8/1994 | Kay | |
| D388,882 | S | | 1/1998 | Kain | |
| 5,722,507 | A | | 3/1998 | Kain | |
| 5,740,883 | A | | 4/1998 | Trank | |
| D410,550 | S | | 6/1999 | Meyers | |
| 6,000,497 | A | * | 12/1999 | Kain et al. | 182/129 |
| D433,156 | S | | 10/2000 | Gibson et al. | |
| D444,574 | S | | 7/2001 | Gibson et al. | |

FOREIGN PATENT DOCUMENTS

| | | | |
|---|---|---|---|
| FR | 2 603 651 | | 3/1988 |
| GB | 680931 | | 10/1952 |
| GB | 2244753 A | * | 12/1991 |
| GB | 2 347 114 | | 8/2000 |

* cited by examiner

*Primary Examiner*—Alvin C Chin-Shue
(74) *Attorney, Agent, or Firm*—Barnes & Thornburg LLP

(57) ABSTRACT

A step stool includes a step frame and a handrail movable relative to the step frame between lowered and raised positions. The handrail includes a handle and left and right handle support arms coupled to the handle to allow sliding movement of the handle relative to the left and right handle support arms as the handrail is moved relative to the step frame between raised and lowered positions. A tray is mounted for pivotable movement on a handle located between the left and right handle support arms about a pivot axis established by the handle.

20 Claims, 7 Drawing Sheets

STEP STOOL WITH MOVABLE HANDRAIL

BACKGROUND AND SUMMARY

The present disclosure relates to a step stool, and particularly to a foldable step stool. More particularly, the present disclosure relates to a foldable step stool including steps mounted on a frame and a handrail mounted for movement relative to the frame.

Step stools have a step frame and one or more steps that people use for elevation when reaching for objects, painting walls, or any everyday task where extra elevation would be helpful. Step frames are often foldable for ease of storage when the step stool is not being used.

According to the present disclosure, a step stool includes a step frame and a handrail movable relative to the step frame between lowered and raised positions. The handrail includes a handle and splayed left and right handle support arms coupled to the handle to allow sliding movement of the handle relative to the left and right handle supports as the handrail is moved relative to the step frame between the lowered and raised positions.

In illustrative embodiments of the present disclosure, a left end of the handle extends into a passageway formed in the left handle support arm for sliding movement therein. A right end of the handle extends into a passageway formed in the right handle support arm for sliding movement therein. An exposed portion of the handle is "visible" between distal ends of the left and right handle support arms.

During movement of the handrail, an effective length of the exposed portion of the handle is maximized upon "downward" movement of the splayed left and right handle support arms relative to the step frame toward the lowered position. Further, the effective length of the exposed portion of the handle is minimized upon "upward" movement of the splayed left and right handle support arms relative to the step frame toward the raised position.

A tray is mounted for pivotable movement on the exposed portion of the handle about an axis established by the handle. Such pivotable movement is allowed regardless of the location of the handrail relative to the step frame. The tray can be pivoted from a storage position arranged to lie in a "plane" established by the movable handrail to a horizontal, use position arranged to lie at an angle to the plane established by the movable handrail.

Additional features of the disclosure will become apparent to those skilled in the art upon consideration of the following detailed description of preferred embodiments exemplifying the best mode of carrying out the disclosure as presently perceived.

BRIEF DESCRIPTION OF THE DRAWINGS

The detailed description particularly refers to the accompanying figures in which:

FIG. 4 is a perspective view of the step stool of FIGS. 1-3 in an expanded, use position showing the handrail in a lowered position and the tray in a horizontal use position;

FIG. 5 is a perspective view similar to FIG. 4 showing the handrail in an intermediate position and the tray in a storage position lying, for example, in a "plane" established by the movable handrail;

FIG. 6 is a perspective view similar to FIGS. 4 and 5 showing the handrail in a raised position and the tray restored to the horizontal use position;

DETAILED DESCRIPTION OF THE DRAWINGS

Figure 1:
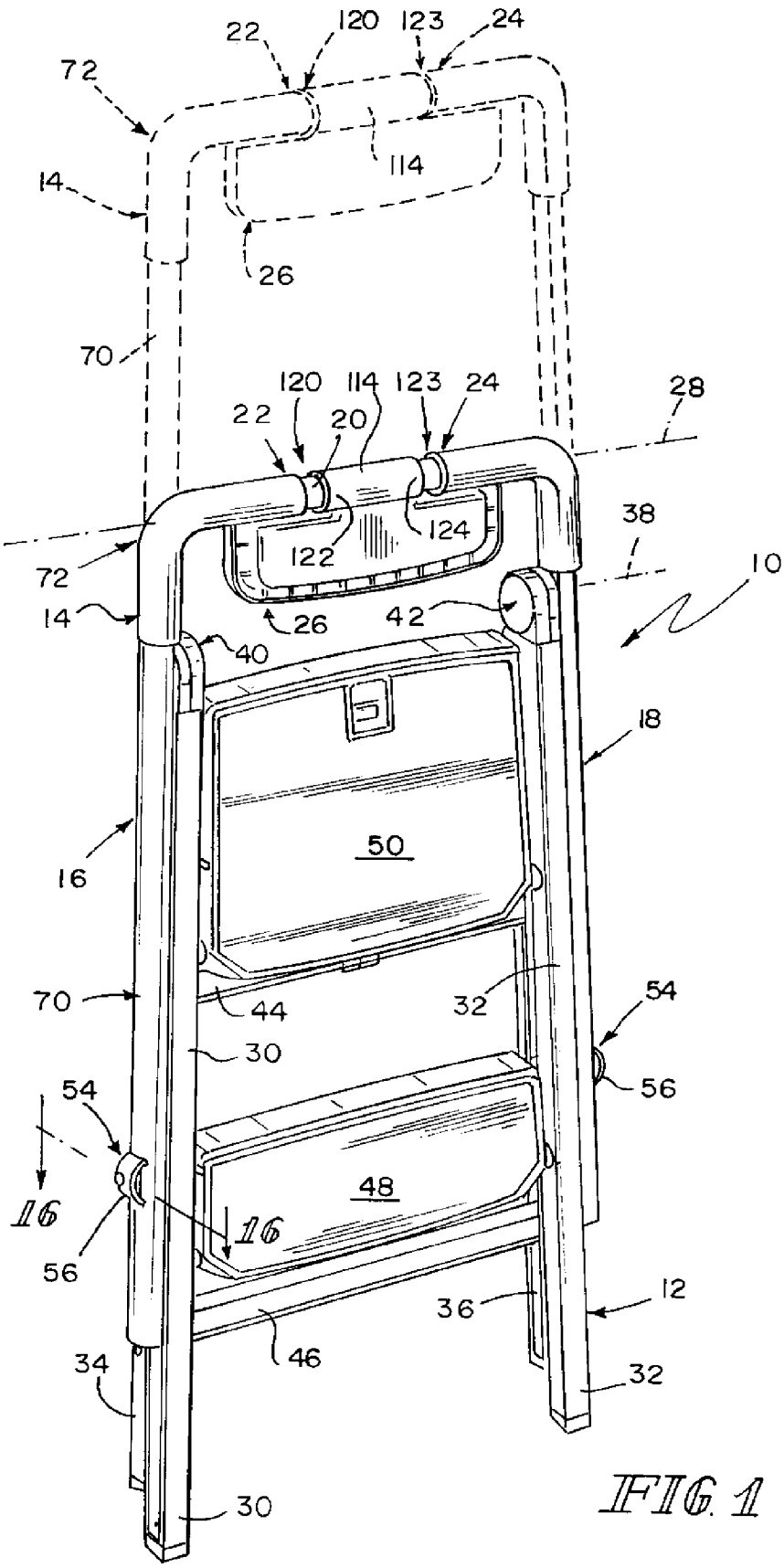
FIG. 1 is a perspective view of a collapsed step stool in accordance with the present disclosure showing a handrail carrying a pivotable tray in a lowered position (in solid) relative to a step frame and upward movement of the handrail to a raised position (in phantom) relative to the step frame.

A foldable step stool 10 includes a step frame 12 and a handrail 14 mounted for movement on step frame 12 as suggested in FIG. 1 from a lowered position (in solid) to a raised position (in phantom). Handrail 14 includes splayed left and right handle supports 16, 18 and a handle 20 arranged to interconnect and slide relative to upper distal ends 22, 24 of the left and right handle supports 16, 18. These upper distal ends 22, 24 move away from one another when handrail 14 is moved to its lowered position as suggested in FIGS. 1 and 9 and more toward one another when handrail 14 is moved to its raised position as suggested in FIGS. 1 and 13. A tray 26 is mounted for pivotable movement on handle 20 of handrail 14 for pivotable movement about a pivot axis 28 established by handle 20 as suggested in FIGS. 1, 14, and 15.

Figure 2:
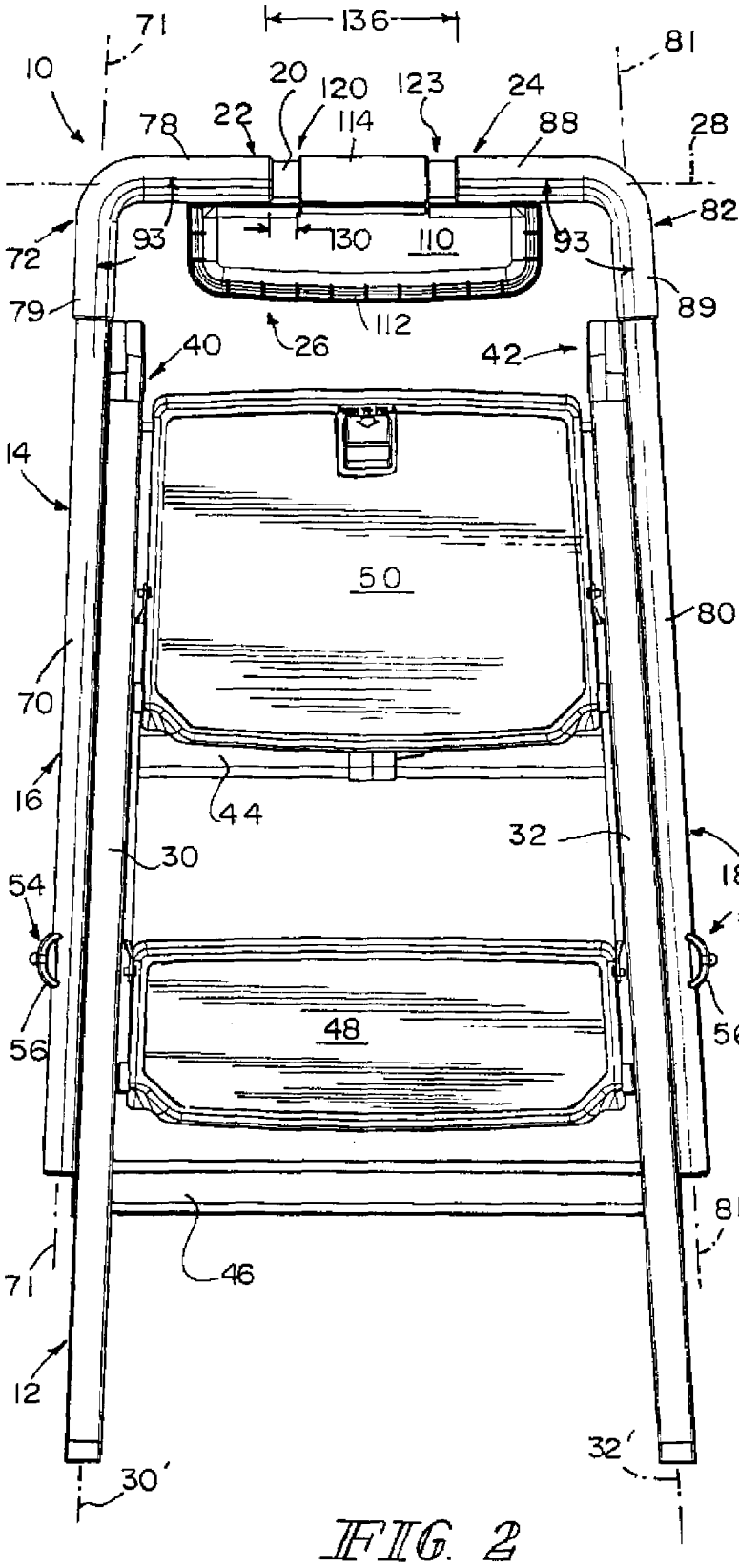
FIG. 2 is a front elevation view of the collapsed step stool of FIG. 1 showing a left leg of the step frame, a right leg of the step frame arranged to lie in a splayed, non-parallel relation to the left leg, and steps between the left and right legs and showing the tray mounted for pivotable movement on a handle included in the handrail and splayed left and right handle support arms included in the handrail and arranged to support the handle and move in upward and downward directions on the left and right legs of the step frame as the handrail moves between its lowered and raised positions.
Figure 3:
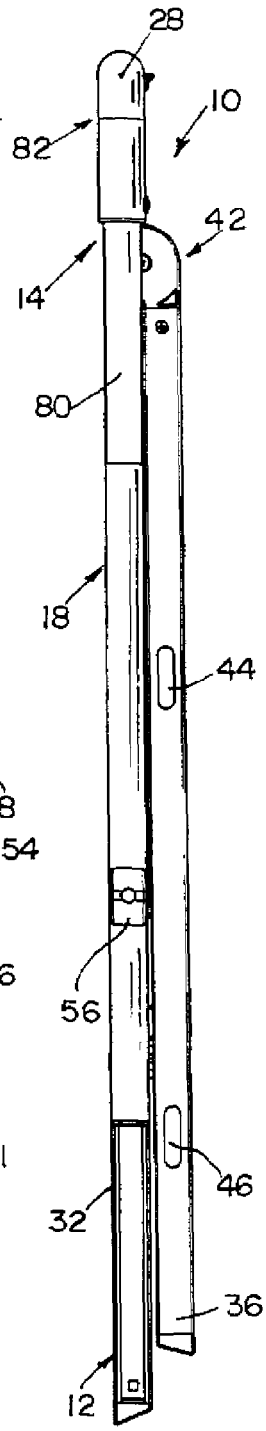
FIG. 3 is a side elevation of the collapsed step stool of FIG. 2 showing a "flat-fold" feature of the step stool.
Figure 4:
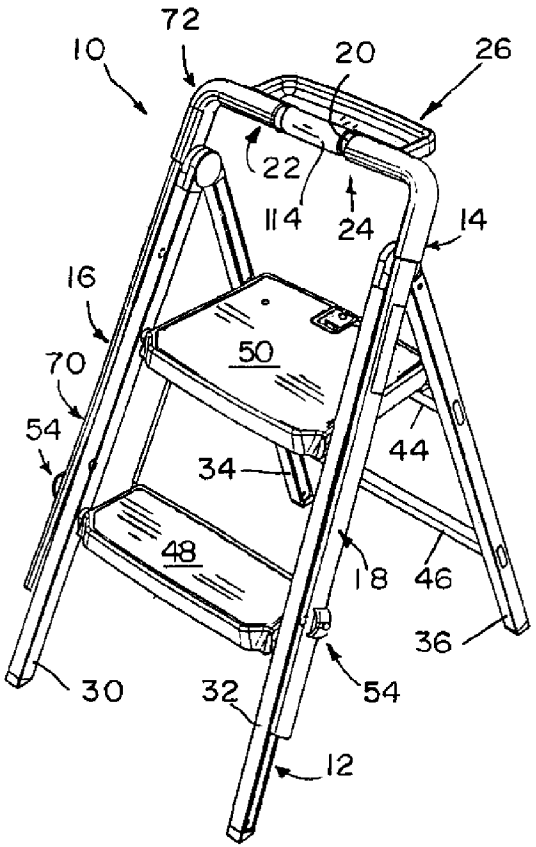

As shown best in FIGS. 2-4, step frame 12 includes front left and right legs 30, 32 arranged to lie in non-parallel relation to one another (along reference lines 30' and 32') and to support handrail 14 for upward and downward sliding movement thereon between the lowered and raised positions. Step frame 12 also includes rear left and right legs 34, 36, which legs are also arranged to lie in nonparallel relation to one another. The stability of step frame 12 is enhanced by such an arrangement of legs 30, 32, 34, and 36.

Figure 6:
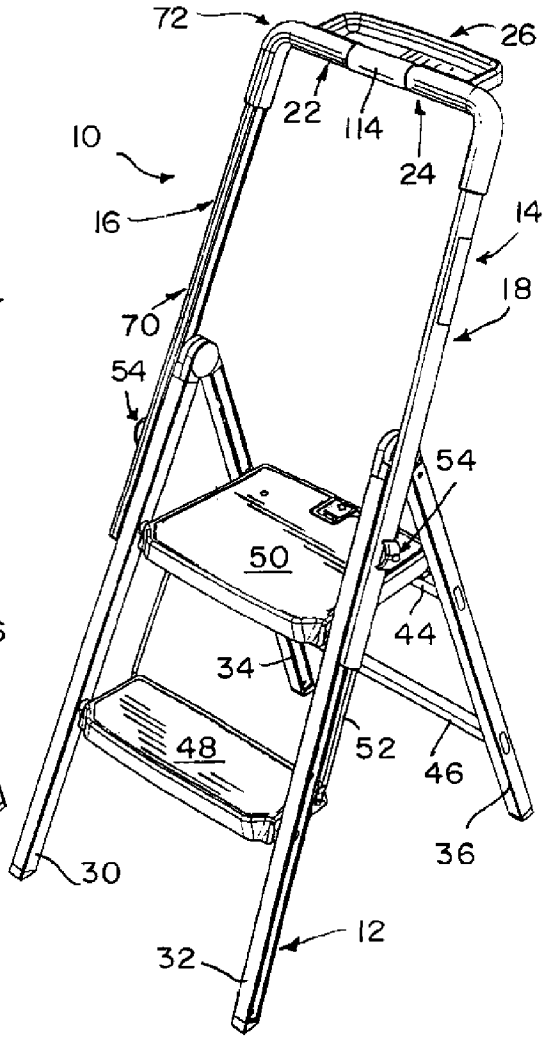
FIGS. 4-6 show movement of the handrail relative to the step frame from a lowered position to a raised position.
Figure 5:
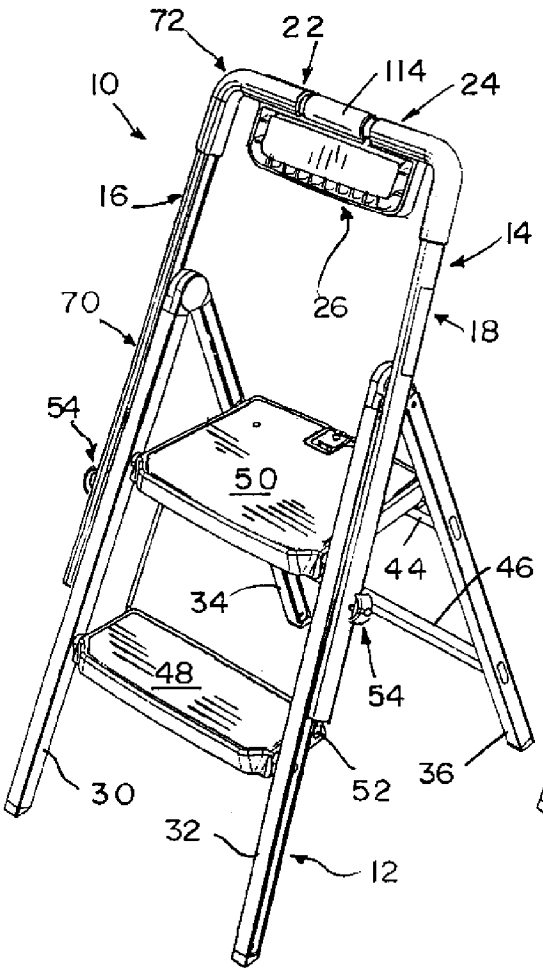

Step frame 12 is able to unfold from the collapsed storage position shown in FIGS. 1-3 to the expanded use position shown in FIGS. 4-6 because front left leg 30 is coupled to rear left leg 34 for pivotable movement about pivot axis 38 at pivot 40 and front right leg 32 is coupled to rear right leg 36 at pivot 42. Step frame 12 further includes upper and lower cross bars 44, 46 interconnecting rear left and right legs 34, 36 as suggested in FIGS. 1-4 to provide lateral stability to rear left and right legs 34, 36.

A pair of steps 48, 50 are mounted on step frame 12 for movement between storage positions shown, for example, in FIGS. 1 and 2 and use positions shown, for example, in FIGS. 4-6 and 8, 10, and 12. Although two steps are illustrated, it is within the scope of this disclosure to mount any suitable number of steps on step frame 12. A lower step 48 is mounted for movement on non-parallel front left and right legs 30, 32. An upper step/platform 50 is mounted for movement on non-parallel front left and right legs 30, 32 and also on non-parallel rear left and right legs 34, 36. A pair of links 52 are pivotably coupled to steps 48 and 50 as suggested, for example, in FIGS. 8, 10, 12 to form "parallelogram support" structures to guide pivotable movement of steps 48, 50 between the storage and use positions.

Movable handrail 14 includes a left handle support arm 16 that is mounted for movement in upward and downward directions along front left leg 30 of step frame 12 as suggested in the illustrative sequence shown in FIGS. 4-6. Likewise, right handle support arm 18 is mounted for movement in upward and downward directions along front right leg 32 of step frame 12 as also suggested in FIGS. 4-6. As shown in. for example, FIGS. 4-6 support arms 16, 18 slide on the outside of legs 30, 32 between the front and back of legs 30, 32. Such movement occurs during movement of handrail 14 from the lowered position (relative to step frame 12) shown in FIGS. 4 to an intermediate position shown in FIG. 5 and then to the raised position shown in FIG. 6.

As shown best in FIG. 1, left and right handle support arms 16, 18 are arranged to lie in splayed, non-parallel relation to one another to facilitate upward and downward movement of handrail 14 along the non-parallel front left and right legs 30, 32 of step frame 12. It is within the scope of this disclosure to use any suitable coupling to enable sliding movement of left and right handle support arms 16, 18 on front left and right legs 30, 32 of step frame 12.

Lock mechanisms 54 are mounted on left and right handle support arms 16, 18 to move therewith and adapted to engage front left and right legs 30, 32 in selected positions thereon to anchor handrail 14 on step frame 12 in either the lowered, intermediate, or raised position as suggested in FIGS. 4-6, 16, and 17. Each lock mechanism 54 includes a pull knob 56, a lock base 58 containing a biasing spring 57, and a bolt 60 configured to pass through passageway 59 formed in lock base 58. Bolt 60 has an outer end 62 coupled to pull knob 56 to move therewith and an inner end 64 adapted to pass through an aperture 65 formed in front left and right legs 30, 32 to lock handle rail 14 to step frame 12. Bolts 60 are normally urged by the biasing spring 57 contained in lock base 58 to lock handrail 14 to step frame 12 and can be withdrawn (to unlock handrail 14 for movement relative to step frame 12) by pulling pull knobs 56 in outward directions 66, 68 as suggested in FIG. 7. Apertures such as aperture 65 are established at selected locking sites along the length of front left and right legs 30, 32, which sites correspond, for example, to the location of the lowered, intermediate, and raised positions of handrail 14 relative to step frame 12.

Figure 7:
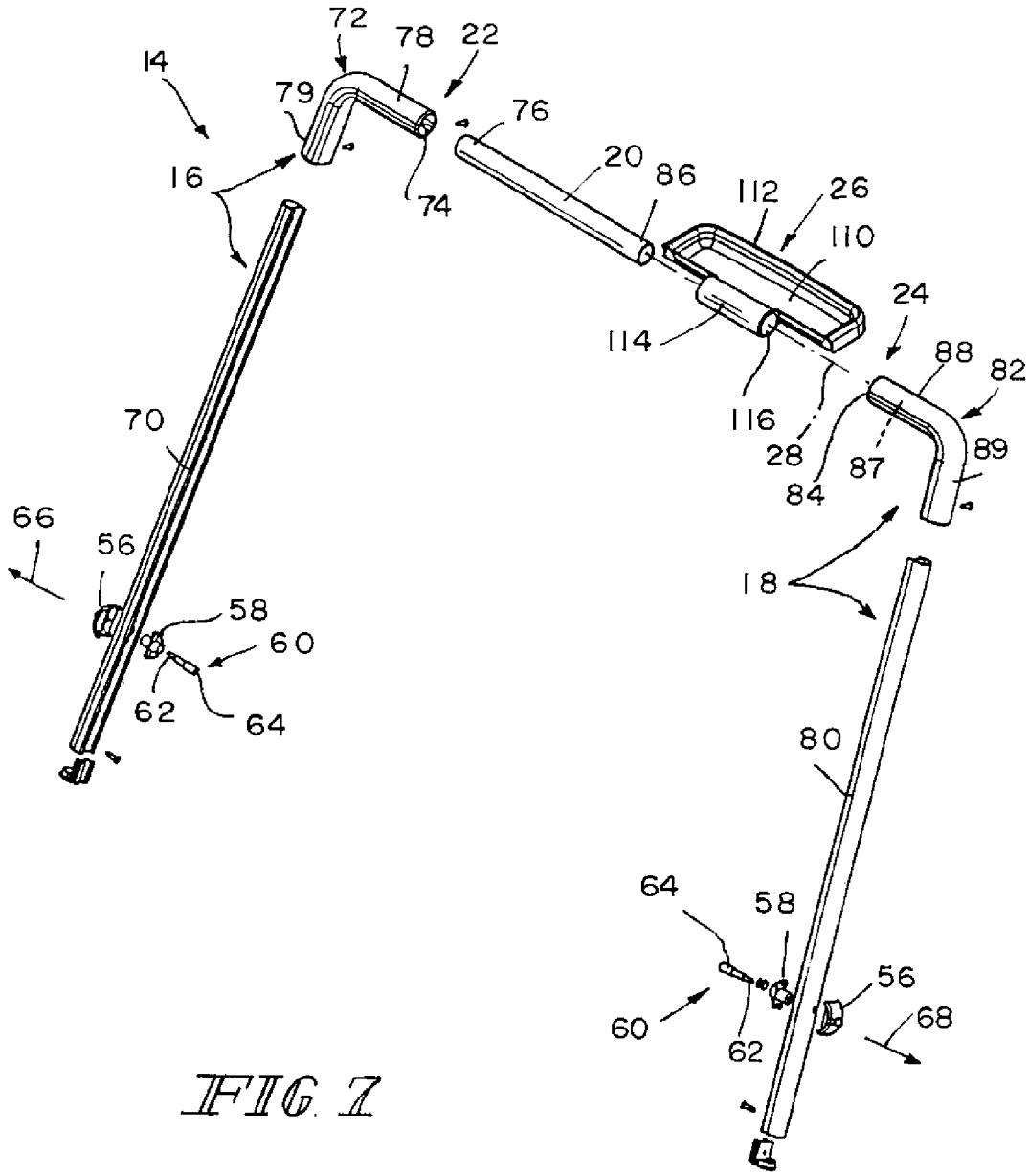
FIG. 7 is an exploded perspective assembly view of the movable handrail showing a cylinder-shaped handle, a tray adapted to be mounted for pivotable movement on the cylinder-shaped handle about a pivot axis established by the handle, and left and right handle support arms, each support arm including an elongated upright segment, an elbow-shaped handle mount, and an arm lock carried on the upright elongated segment and adapted to engage a leg included in the step frame to retain the movable handrail in a selected one of the lowered, intermediate, and raised positions shown in FIGS. 4-6.
Figure 8:
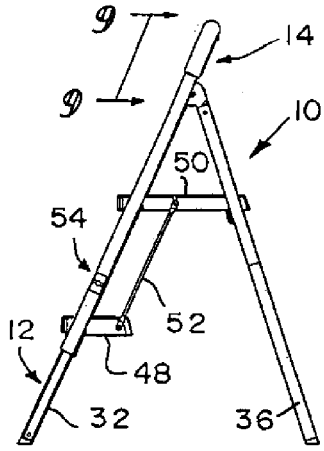
FIG. 8 is a reduced side elevation view of the step stool in the expanded, use position showing the handrail in the lowered position.

Left handle support arm 16 includes an elongated upright segment 70 and a handle mount 72 as shown, for example, in FIGS. 2 and 7. Elongated upright segment 70 is mounted on front left leg 30 for reciprocable movement in upward and downward directions. Handle mount 72 is coupled to an upper end of elongated upright segment 70 and is formed to include a left-end opening 74 in upper distal end 22, which left-end opening 74 is adapted to receive a left end 76 of handle 20 as suggested in FIG. 7.

As shown best in FIG. 2, left handle mount 72 includes a lateral segment 78 arranged to lie at an obtuse angle 93 of about 93 degrees relative to a center line 71 established by elongated upright segment 70. Lateral segment 78 is formed to include a passageway terminating at left-end opening 74 (as suggested in FIG. 7) and receiving left end 76 of handle 20 for sliding movement therein. In the illustrated embodiment, left handle mount 72 is elbow-shaped and includes a base segment 79 arranged to lie at obtuse angle 93 relative to lateral segment 78. Base segment 79 is coupled to an upper end of elongated upright segment 70. Lateral segment 78 is tubular and left end 76 of handle 20 is cylinder-shaped and sized to extend into and slide back and forth in the passageway formed in tubular lateral segment 78.

Right handle support arm 18 also includes an elongated upright segment 80 and a handle mount 82 as shown, for example, in FIGS. 2 and 7. Elongated upright segment 80 is mounted on front right leg 32 for reciprocable movement in upward and downward directions. Handle mount 82 is coupled to an upper end of elongated upright segment 80 and is formed to include a right-end opening 84 in upper distal end 24, which right-end opening 84 is adapted to receive a right end 86 of handle 20 as suggested in FIG. 7.

As shown best in FIG. 2, right handle mount 82 includes a lateral segment 88 arranged to lie at obtuse angle 93 (of about 93 degrees) relative to a center line 81 established by elongated upright segment 80. Lateral segment 88 is formed to include a passageway 87 terminating at right-end opening 84 (as suggested in FIG. 7) and receiving right end 86 of handle 20 for sliding movement therein. In the illustrated embodiment, right handle mount 82 is elbow-shaped and includes a base segment 89 arranged to lie at obtuse angle 93 relative to lateral segment 78. Base segment 89 is coupled to an upper end of elongated upright segment 80. Lateral segment 88 is tubular and right end 86 of handle 20 is cylinder-shaped and sized to extend into and slide back and forth in passageway 87 formed in tubular lateral segment 88.

As shown in FIG. 7, tray 26 includes a tray surface 110 and a rim 112 around a portion of the perimeter edge of tray surface 110. A mount sleeve 114 is coupled to another portion of the perimeter edge of tray surface 110. Mount sleeve 114 is formed to include a passageway 116 receiving an "exposed portion" (i.e., a portion of handle 20 located between distal ends 22, 24 of left and right handle supports 16, 18) therein to support tray 26 for pivotable movement about pivot axis 28 established by handle 20. It is within the scope of this disclosure to provide a step stool 10 without a tray 26.

Figure 9:
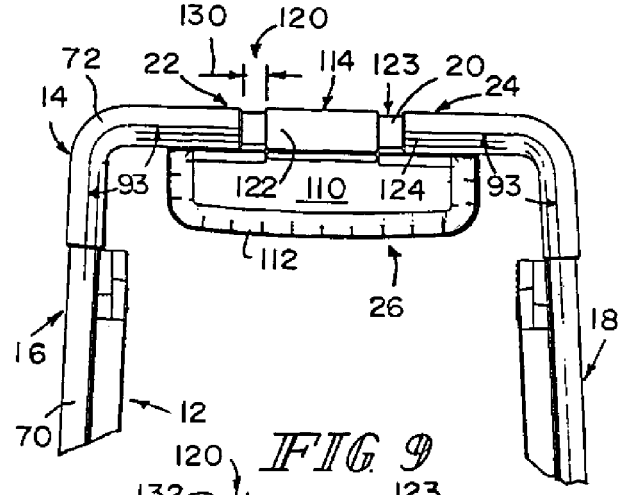
FIG. 9 is an enlarged view of a portion of the handrail taken along line 9-9 of FIG. 8 showing a left end of a mount sleeve included in the tray arranged to lie in confronting and spaced-apart relation to a distal portion of the elbow-shaped handle mount of the left handle support arm to define a "wide" left-side gap therebetween (when the handrail is in the lowered position)
Figure 10:
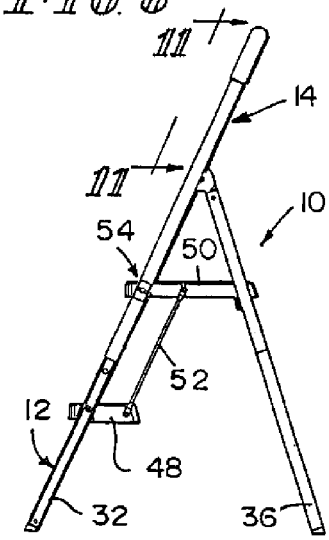
FIG. 10 is a view similar to FIG. 8 showing the handrail in the intermediate position.
Figure 11:
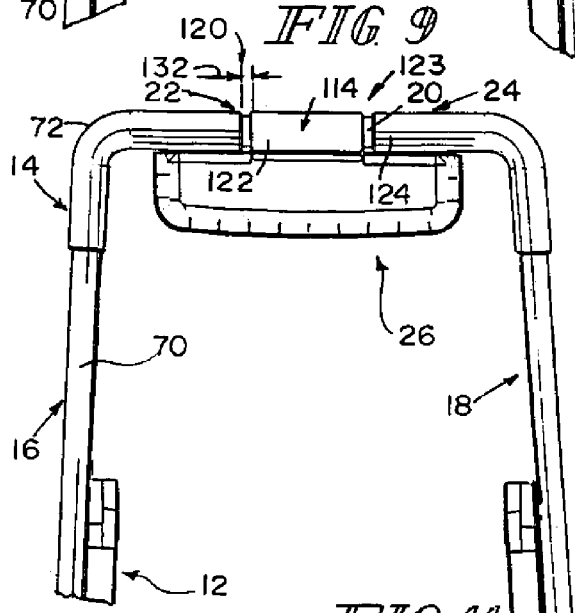
FIG. 11 is an enlarged view of a portion of the handrail taken along line 11-11 of FIG. 10 showing "narrowing" of the left-side gap between the sleeve mount of the tray and the elbow-shaped handle mount of the left handle support arm when the handrail is in the intermediate position.
Figure 12:
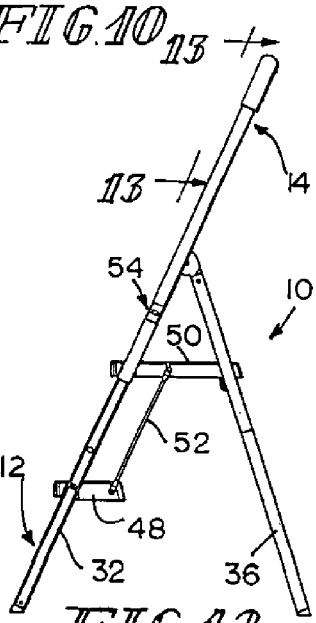
FIG. 12 is a view similar to FIGS. 8 and 10 showing the handrail in the raised position.
Figure 13:
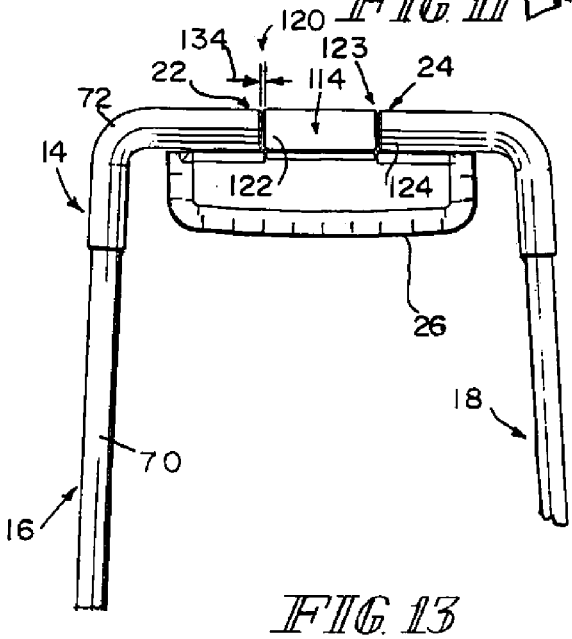
FIG. 13 is an enlarged view of a portion of the handrail taken along line 13-13 of FIG. 12 showing further narrowing of the left-side gap between the sleeve mount of the tray and the elbow-shaped handle mount of the left handle support arm.

Referring now to FIGS. 9, 11, and 13, it is evident that a left-side gap 120 (i.e., a space) is defined by the spacing between distal end 22 of left handle support arm 16 and a left end 122 of mount sleeve 114 of tray 26. Likewise, a right-side gap 123 is defined by the spacing between distal end 24 of right handle support arm 18 and a right end 124 of mount sleeve 114. These gaps 120, 123 are also shown, for example, in FIGS. 1, 2, 4-6, 14, and 15.

Handle 20 is arranged to move telescopically and slide in passageways formed in distal ends 22, 24 of left and right handle support arms 16, 18. Such telescoping and sliding movement causes left-side gap 120 (and right-side gap 123) to "widen" to assume wide dimension 130 upon downward movement of splayed left and right handle support arms 16, 18 toward the lowered position of movable handrail 14 as shown in FIG. 9 so long as mount sleeve 114 remains in an axially fixed position on the exposed portion of handle 20. Further, left-side gap 120 (and right-side gap 123) "narrow" to assume intermediate dimension 132 upon upward movement of splayed left and right handle support arms 16, 18 from the lowered position to the intermediate position shown in FIG. 11. Still further, left-side gap 120 (and right-side gap 123) narrow further to assume narrow dimension 134 upon continued upward movement of splayed left and right handle support arms 16, 18 to the raised position shown in FIG. 13. This narrowing and widening of gaps 120, 123 is also shown in FIG. 1.

In this disclosure, means is disclosed for slidably coupling handle 20 to left and right handle support arms 16, 18 to cause left end 122 of handle 20 to extend into a left-end opening formed in distal end 22 of left handle support arm 16 and right end 124 of handle 20 to extend into a right-end opening formed in distal end 24 of right handle support arm 18 to produce an exposed portion of handle 20 in a position between left and right support arms 16, 18 as shown, for example, in FIGS. 1 and 2. Using such means, handle 20 is supported for sliding movement relative to at least one of left and right handle support arms 16, 18 so that an effective length 136 (FIG. 2) of the exposed portion of handle 20 is (1) maximized upon downward movement of left and right handle support arms 16, 18 relative to the non-parallel left and right legs 30, 32 of step frame 12 to establish a lowered position of movable handrail 14 on step frame and is (2) minimized upon upward movement of left and right handle support arms 16, 18 relative to left and right legs 30, 32 of step frame 12 to establish a raised position of the movable handrail 14 on step frame 12.

Figure 14:
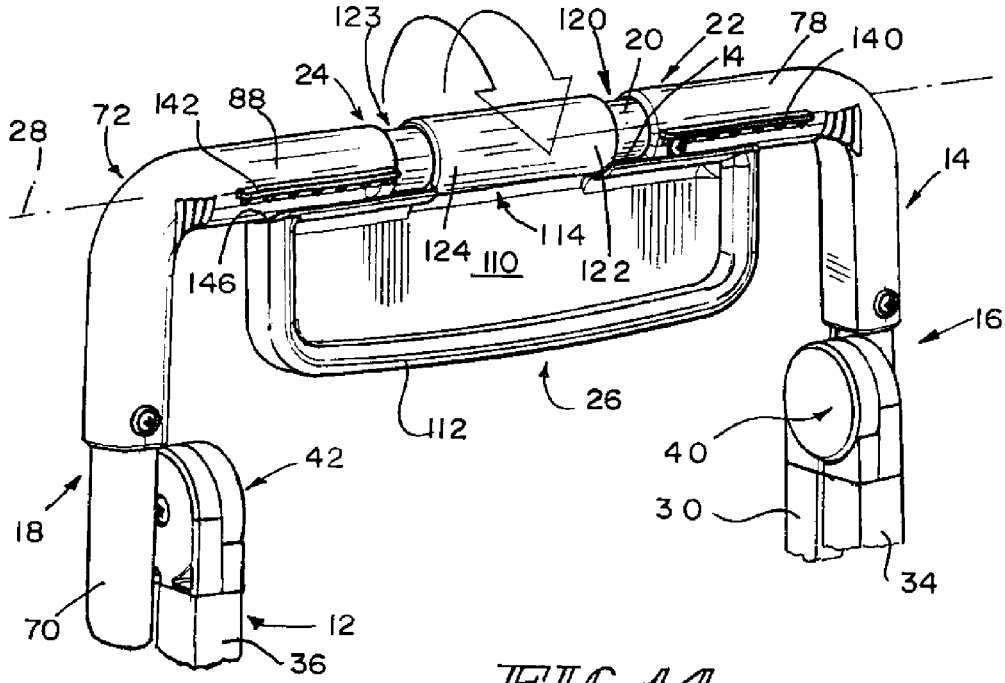
FIG. 14 is an enlarged perspective view of the tray mounted for pivotable movement on the cylinder-shaped handle included in the handrail.
Figure 15:
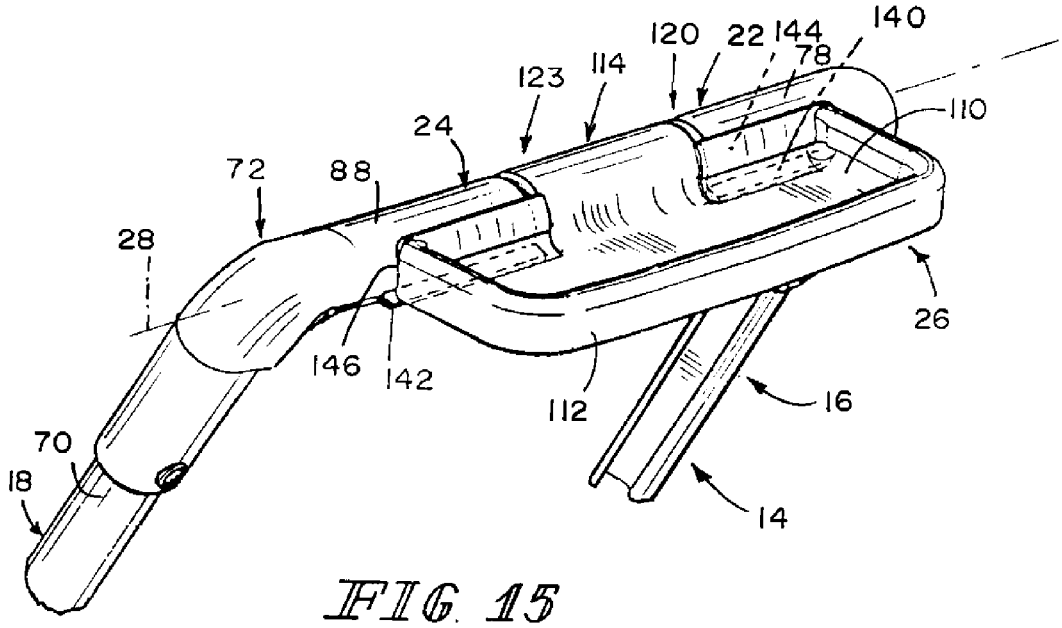
FIG. 15 is a perspective view showing the tray after it has been pivoted about an axis established by the handle to assume a horizontal use position and retained in the horizontal use position by engagement with an underlying spaced-apart pair of elongated narrow tray support platforms (shown in phantom) appended to the left and right elbow-shaped handle mounts included in the handrail.
Figure 16:
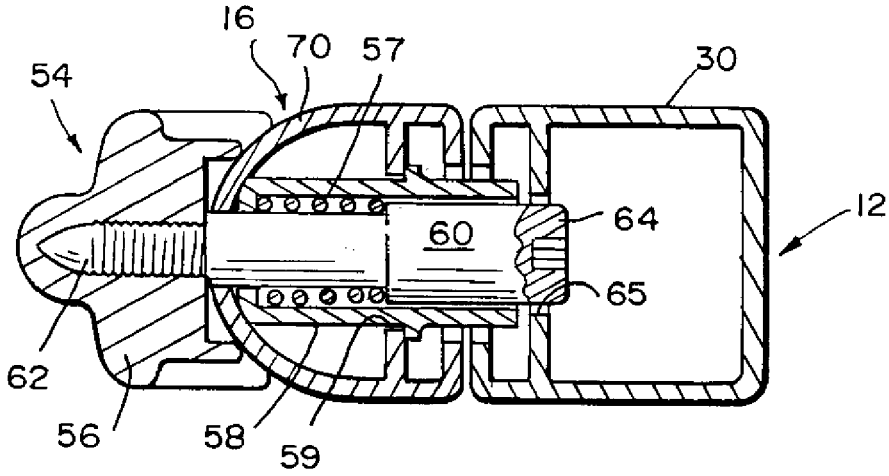
FIG. 16 is a sectional view taken along line 16-16 of FIG. 1 showing a lock mechanism in a locked position to retain the handrail in the lowered position on the step frame.
Figure 17:
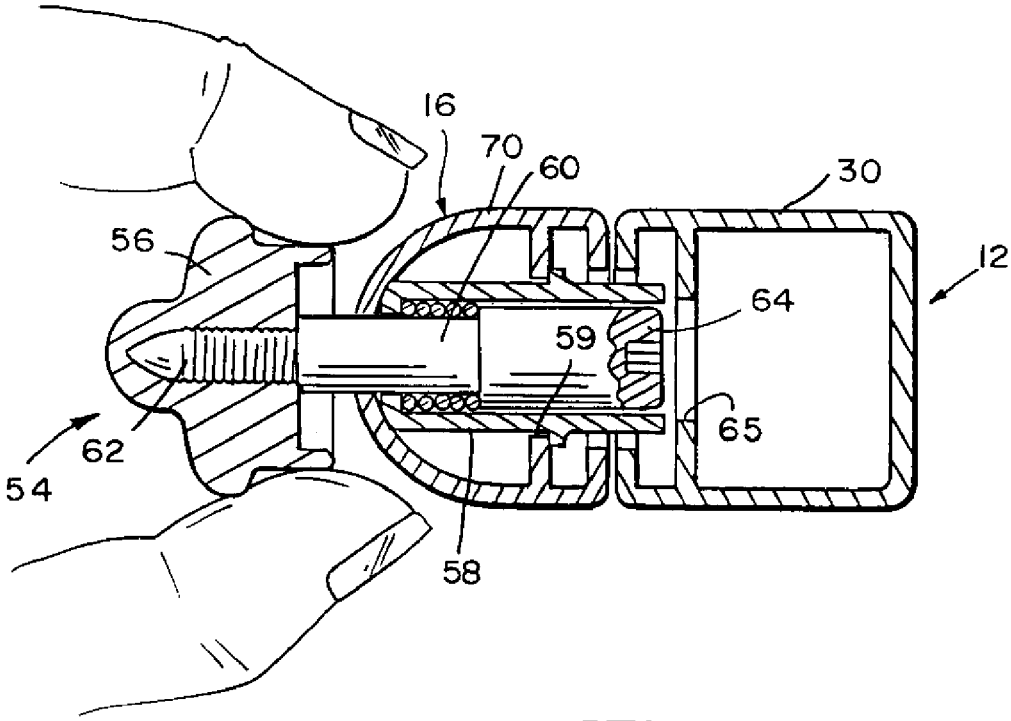
FIG. 17 is a sectional view similar to FIG. 16 showing a user moving a pull knob against a spring to withdraw a bolt from engagement from an aperture formed in the front left leg to allow movement of the handrail relative to the step frame.

As shown, for example, in FIGS. 14, and 15, tray support platforms 140, 142 are used to support tray 26 in a horizontal position upon pivotable movement of ray 26 about pivot axis 28 established by handle 20 to assume the horizontal position. A first tray support platform 140 is coupled to lateral segment 78 included in left handle support arm 16. A second tray support platform 142 is coupled to lateral segment 88 included in right handle support arm 18. Each platform 140, 142 is illustratively an elongated narrow reinforced shelf arranged to underlie a portion of the perimeter of tray 26 as shown in FIG. 15 to support tray 26 in the horizontal position.

Tray 26 also includes channel means for riding on exterior surfaces of lateral segments 78, 88 in rotating bearing engagement as tray 26 is pivoted about pivot axis 28 established by handle 20 so that tray 20 is retained in a predetermined relative position relative to pivot axis 28 during pivotable movement of tray 26 about pivot axis 28. As shown in FIGS. 14 and 15, the exterior surface of each of lateral segments 78, 88 is cylinder-shaped and the channel means includes a "left-side" concave surface 144 arranged to lie in confronting and mating relation with the cylinder-shaped exterior surface of lateral segment 78 and a "right-side" concave surface 146 arranged to lie in confronting and mating relation with the cylinder-shaped exterior surface of lateral segment 88.

The invention claimed is:

1. A step stool comprising a frame including two front legs, a left leg and a right leg, arranged to lie in non-parallel relation, steps coupled to the frame, one rear leg pivotally coupled above all of the steps to one of the two front legs, and a movable handrail including a left handle support arm mounted for movement in upward and downward directions along and collinear with and slidably engaging the outside between the front and back of the left leg, a right handle support arm mounted for movement in upward and downward directions along and collinear with and slidably engaging the outside between the front and back of the right leg, a handle, and means for slidably coupling the handle to the left and right handle support arms to cause a left end of the handle to extend into a left-end opening formed in the left handle support arm and a right end of the handle to extend into a right-end opening formed in the right handle support arm to produce an exposed portion of the handle in a position between the left and right handle support arms and to support the handle for sliding movement relative to at least one of the left and right handle support arms so that an effective length of the exposed portion is maximized upon downward movement of the left and right handle support arms relative to the non-parallel left and right legs of the frame to establish a lowered position of the movable handrail on the frame and is minimized upon upward movement of the left and right handle support arms relative to the left and right legs of the frame to establish a raised position of the movable handrail on the frame.

2. The step stool of claim 1, wherein the left handle support arm includes an elongated upright segment mounted on the left leg for reciprocable movement in the upward and downward directions and a handle mount coupled to the elongated upright segment and formed to include the left-end opening.

3. The step stool of claim 2, wherein the handle mount includes a lateral segment arranged to lie at an obtuse angle relative to the elongated upright segment and the lateral segment is formed to include a passageway left-end opening and receiving the left end of the handle for sliding movement therein.

4. The step stool of claim 3, wherein the handle mount is elbow-shaped and includes a base segment arranged to lie at the obtuse angle relative to the lateral segment and coupled to an upper end of the elongated upright segment.

5. The step stool of claim 3, wherein the lateral segment is tubular and the left end of the handle is cylinder-shaped and sized to extend into and slide back and forth in the passageway formed in the tubular lateral segment.

6. The step stool of claim 2, wherein the right handle support arm includes an elongated upright segment mounted on the right leg for reciprocable movement in the upward and downward directions and arranged to lie in non-parallel relation to the elongated upright segment of the left handle support arm and a handle mount formed to include the right-end opening and coupled to the elongated upright segment of the right handle support arm.

7. The step stool of claim 6, wherein the handle mount of the left handle support arm includes a lateral segment formed to include a passageway terminating at the left-end opening and receiving the left end of the handle for sliding movement therein, the handle mount of the right handle support arm includes a lateral segment formed to include a passageway terminating at the right-end opening and receiving the right end of the handle for sliding movement therein, and the lateral segments included in the handle mounts of the left and right handle support arms are aligned in collinear, spaced-apart relation to locate the exposed portion of the handle therebetween.

8. The step stool of claim 1, further comprising a tray and a mount sleeve coupled to the tray and formed to include a passageway receiving a portion of the exposed portion of the handle therein to support the tray for pivotable movement about an axis established by the handle.

9. The step stool of claim 8, wherein the mount sleeve includes a left end arranged to lie in confronting relation to a distal portion of the left handle support arm formed to include the left-end opening to define a left-side gap therebetween and wherein the handle is arranged to move relative to the distal portion of the left handle support arm to cause the left-side gap to widen upon downward movement of the left handle support arm toward the lowered position of the movable handrail and to narrow upon movement of the left handle support arm toward the raised position so long as the mount sleeve remains in an axially fixed position on the exposed portion of the handle.

10. The step stool of claim 8, further comprising a tray support platform coupled to at least one of the left and right handle support arms and arranged to support the tray in a horizontal position upon pivotable movement of the tray about the axis established by the handle to assume the horizontal position.

11. The step stool of claim 10, wherein each of the left and right handle support arms includes a lateral segment arranged to extend along the axis established by the handle, the lateral segment included in the left handle support arm is formed to include the left- end opening, the lateral segment included in the right handle support arm is formed to include the right-end opening, a first of the tray support platforms is coupled to the lateral segment included in the left handle support arm, and a second of the tray support platforms is coupled to the lateral segment included in the right handle support arm.

12. The step stool of claim 8, wherein the left handle support arm includes a left-side lateral segment formed to include the left-end opening, the right handle support arm includes a right-side lateral segment formed to include the right-end opening, and the tray includes channel means for riding on exterior surfaces of the left-side and right-side lateral segments in rotative bearing engagement therewith as the tray is pivoted about the axis established by the handle so that the tray is retained in a predetermined radial position relative to the axis established by the handle during pivotable movement of the tray about the axis established by the handle.

13. The step stool of claim 12, wherein the left handle support arm further includes an elongated upright segment fixed to lie at an obtuse to the left-side lateral segment and mounted on the left leg for reciprocable movement in the upward and downward directions and the right handle support arm further includes an elongated upright segment fixed to lie at an obtuse angle relative to the right-side lateral segment and mounted on the right leg for reciprocable movement in the upward and downward directions.

14. The step stool of claim 12, wherein the exterior surface of each of the left-side and right-side lateral segments is cylinder-shaped an means includes a left-side concave surface arranged to lie in confronting and mating relation with the cylinder-shaped exterior surface of the left-side lateral segment and a right-side concave surface arranged to lie in confronting and mating relation with the cylinder-shaped exterior surface of the right-side lateral segment.

15. The step stool of claim 13, wherein the mount sleeve is positioned to lie between the left-side and right-side concave surfaces.

16. A step stool comprising a frame including two front legs, a left leg and a right leg, arranged to lie in non-parallel relation, steps coupled to the frame, one rear leg pivotally coupled to one of the two front legs at an end of the frame spaced from all of the steps, and a movable handrail including a handle having a left end and a right end, a left handle support mounted for movement in upward and downward directions on, collinear with and slidably engaging the outside between the front and back of the left leg and formed to include a handle receiver arranged to receive the left end of the handle for slidable movement therein, and a right handle support mounted for movement in upward and downward directions collinear with and slidably engaging the outside between the front and back of the right leg and formed to include a handle receiver arranged to receive the right end of the handle for slidable movement therein.

17. The step stool of claim 16, wherein each of the left and right handle supports includes a lateral segment formed to include the handle receiver and an elongated upright segment arranged to lie at an obtuse angle to the lateral segment thereof and mounted on a selected one of the left and right legs for reciprocable movement thereon.

18. The step stool of claim 16, wherein the handle is cylinder-shaped and each handle receiver is formed to define a passageway receiving a of the cylinder-shaped handle for sliding movement therein upon downward movement of the left and right handle supports relative to the non-parallel left and right legs of the frame to establish a lowered position of the movable handrail on the frame and upon upward movement of the left and right handle supports relative to the non-parallel left and right legs of the frame to establish a raised position of the movable handrail on the frame.

19. The step stool of claim 16, further comprising a tray and means for mounting the tray in rotative bearing engagement on an exposed portion of the handle located between the handle receivers of the left and right supports for pivotable movement about an axis established by the handle regardless of the position of the handrail relative to the frame.

20. A step stool comprising a frame having legs pivotally joined at a first end, steps coupled to the frame and all of the steps located between the first end and a second end of the legs, and a movable handrail including a handle having a left end and a right end, a left handle support arm formed to include a handle receiver arranged to receive the left end of the handle for slidable movement therein, and a right handle support arm formed to include a handle receiver arranged to receive the right end of the handle for slidable movement therein, the left and right handle support arms being oriented to lie in splayed relation to one another and mounted on the frame for downward movement collinear with respect to and slidably engaging the outside between the front and back of the frame to establish a lowered position relative to the frame and for upward movement to establish a raised position relative to the frame.

* * * * *